United States Patent [19]

Ashburner

[11] 4,228,992

[45] Oct. 21, 1980

[54] SHEET SELECTING AND DISPENSING APPARATUS

[75] Inventor: Adi K. Ashburner, Hargrave, England

[73] Assignee: Harper & Tunstall, Limited, Dennington, England

[21] Appl. No.: 963,423

[22] Filed: Nov. 24, 1978

[51] Int. Cl.[3] ..... B65H 43/00

[52] U.S. Cl. ..... 270/59; 270/46

[58] Field of Search ..... 270/59, 46, 58; 355/35 H, 103; 200/61.13

[56] References Cited

U.S. PATENT DOCUMENTS

| | | | |
|---|---|---|---|
| 3,279,787 | 10/1966 | Niccoli | 270/59 |
| 3,943,311 | 3/1976 | Ashburner | 200/61.13 |

*Primary Examiner*—Robert E. Bagwill

*Attorney, Agent, or Firm*—Blair, Brown & Kreten

[57] ABSTRACT

Apparatus (1) for automatically selecting a "secondary" sheet (6) of copying paper of a desired size from a store (7) containing secondary sheets (6) of different size arranged in groups (10) of the different sizes and for automatically aligning and associating the selected sheet (6) with a "primary" sheet (3) to be copied, the primary sheet (3) being inserted in the apparatus (1) and the size of the primary sheet (3) being sensed by the apparatus to determine the selection of the secondary sheet (6).

Alignment is effected by bringing the leading edges (4 and 8) of primary and secondary sheets (3 and 6) into abutment with stop means (11 or 12) so that the leading end portion (8) of the secondary sheet (3) is provided with a wave-shaped portion upstream of the leading end portions (5 and 8) of the primary and secondary sheets (3 and 6).

10 Claims, 5 Drawing Figures

SHEET SELECTING AND DISPENSING APPARATUS

TECHNICAL FIELD OF THE INVENTION

The invention relates to an apparatus for automatically selecting a sheet, termed a "secondary" sheet, from a store containing groups of sheets of different sizes and assembling the sheet with a "primary" or "controlling" sheet, the selection being made in dependence upon the size of the primary sheet.

A particular, but not exclusive, application of the invention is to reprographic machines where it is required to match in size a copying paper with an original to be copied and to feed the two superimposed sheets into the copying machine.

In such an application it is important that the two sheets are accurately aligned with each other in order that an acceptable copy may be produced, otherwise the copy will be skewed and part of the original may not be copied.

BACKGROUND ART

It is known to provide a reprographic machine with a sheet dispenser, i.e. a box containing two or more sizes of sheets. An operator selects the required sheet size by a manual operation which causes a roller to dispense a sheet of the desired size from the box. The sheet dispensed together with the original to be copied are manually aligned with each other and fed together into the copying part of the machine.

DISCLOSURE OF THE INVENTION

It is an object of the invention to provide an apparatus in which the sheet selection and the assembly of a pair of sheets in alignment with each other, are performed automatically.

In accordance with the invention there is provided apparatus for automatically selecting a secondary sheet of a desired size and associating and aligning the sheet with a primary sheet, the secondary sheet being selected in accordance with the size of the primary sheet, the apparatus comprising a store containing secondary sheets of different sizes arranged in groups, each group relating to a different sheet size; means for sensing the size of a primary sheet and adapted to operate so that, as the sheet is fed into the apparatus until its leading edge arrives at stop means of the apparatus, the sensing means produces a control signal indicative of the primary sheet size; and means responsive to the control signal for selecting a said group and dispensing a secondary sheet from that group so that the sheet moves away from the group at least until after its leading edge arrives at the stop means, in which position the secondary sheet is associated and aligned with the primary sheet and at least the leading end portion of the secondary sheet faces the primary sheet.

In such an apparatus the primary sheet is conveniently fed along a first feed path having a guide surface so that the sheet is fed square with an abutment extending transversely across the feed path and forming the stop means and the dispensing means preferably operate such that when the secondary sheet engages the abutment the sheet is subjected to a compressive force between its leading edge and a trailing portion so that a wave shape is produced in the sheet and alignment of the sheet, square with the abutment, is facilitated.

To further assist alignment of the secondary sheet with the abutment, the sheet is advantageously subjected to other externally-generated forces such as a vibrating plate or airjets to bring it dead square.

The feed path for the primary sheet is conveniently provided by a first table and a second table disposed below the first table and the secondary sheet is conveniently dispensed along a further feed path situated below the first feed path and provided by the second table, a space between the first and second tables allowing the secondary sheet to assume the wave shape.

Conveniently, the groups of secondary sheets comprise piles of sheets arranged in trays situated beneath the tables and the dispensing means include motor driven rollers for selectively driving sheets out of each pile.

The means for sensing the size of the primary sheet may comprise photocells and/or microswitches.

In one preferred embodiment, the abutment comprises a movable fence controlled by a solenoid itself controlled by a photocell or switch arranged to be actuated by a secondary sheet just before the leading edge of the sheet arrives at the fence, a time delay being provided sufficient for alignment of the sheet with the fence before removal of the fence from the first sheet feed path by the solenoid.

Preferably, an interlock is provided to prevent operation of the solenoid unless the primary sheet is also in contact with the fence.

To enable an aligned pair of superimposed primary and secondary sheets to be fed further forward together, two rollers may be provided upstream of the fence on opposite sides of the primary and secondary sheets, one of the rollers being a driven roller and the other being an idler roller, the idler roller being movable towards and away from the driven roller and being controlled in conjunction with the fence so that when the fence is removed the idler roller presses the sheets between itself and the driven roller to advance the sheets.

In another preferred embodiment, the abutment is formed by the nip between a pair of rollers and after a time delay provided by a photocell situated adjacent the first feed path a clutch of one of the rollers is engaged to advance the pair of primary and secondary sheets, the time delay being sufficient to allow the alignment of the secondary sheet at the nip.

The apparatus is particularly suitable for incorporation in, or association with, a reprographic machine, the primary sheet being the original to be copied and the secondary sheet being the copying paper, the apparatus functioning to select the copying sheet of a size most suitable for matching the original. In many instances the sizes of the original and copying sheet would, of course, be the same.

Advantages of the invention are that the operations of selecting a secondary sheet of the size most appropriate for a primary sheet and of placing the two sheets together in alignment, are performed automatically without any manual intervention. Thus, as compared with a manually-operated apparatus performing the same functions the apparatus of the invention enables these operations to be performed more rapidly and errors due to the selection of a wrong sheet size are eliminated. Also, operator fatigue is reduced since the only operation which may need to be manually performed is the insertion of the primary sheet into the apparatus and this operation may also be performed automatically if required.

The provision of an abutment forming the stop means and extending transversely across the first feed path enables the secondary sheet to be given a wave shape by a compressive force urging it against the abutment, thereby facilitating alignment of the secondary sheet. Thus, the two superimposed sheets are reliably positioned square with each other. This is important in reprographic work in order to obtain a satisfactory copy of an original.

The subjecting of the secondary sheet, when in a wave shape, to a mechanical vibration or the force of airjets further ensures correct alignment of the sheet should it be restricted in its aligning movement by contact with parts of the apparatus.

The first and second superimposed tables provide simple means for supporting the sheets on their feed paths towards the stop means and the spacing between the tables ensures that there is an unobstructed space for the secondary sheet to assume its wave shape.

The provision of trays beneath the tables containing the groups of sheets of different sizes arranged in piles enables the apparatus to be made compact in size and the motor driven rollers for dispensing the secondary sheets comprise an easily-controllable means for the automatic dispensing operation.

The sensing of the size of the primary sheet by photocells or microswitches enables the automatic control function to be provided in a simple manner and at low cost.

By making the abutment in the form of a fence automatically moved out of the feed paths of the sheets after they have been aligned, the apparatus is readily adapted to function in the instance where the pair of sheets is required to be used in a further operation stage by further feeding of the sheets forward together to that stage. The interlock ensures that the sheets must be properly aligned with each other before proceeding to the further stage and thus that the operation, e.g. photo-copying, performed at this stage gives a satisfactory result.

The pair of rollers situated upstream of the fence provide a simple means of advancing the pair of sheets forward after the fence has been raised and, by making the rollers operative automatically in conjunction with the fence movement, a fully automatic operating cycle is readily obtained.

A simplified and thus cheaper construction of the apparatus is made possible by the elimination of the fence and utilizing the nip between the pair of forward feed rollers to function as the stop means.

In the instance where the apparatus is incorporated in a reprographic machine or combined with such a machine, then by causing the pair of forward feed rollers to be driven or controlled by the machine it may be readily ensured that the apparatus functions synchronously with the copying operation.

Embodiments of the invention are hereinafter described, by way of example, with reference to the accompanying drawings.

BEST MODES FOR CARRYING OUT THE INVENTION

Figure 1:
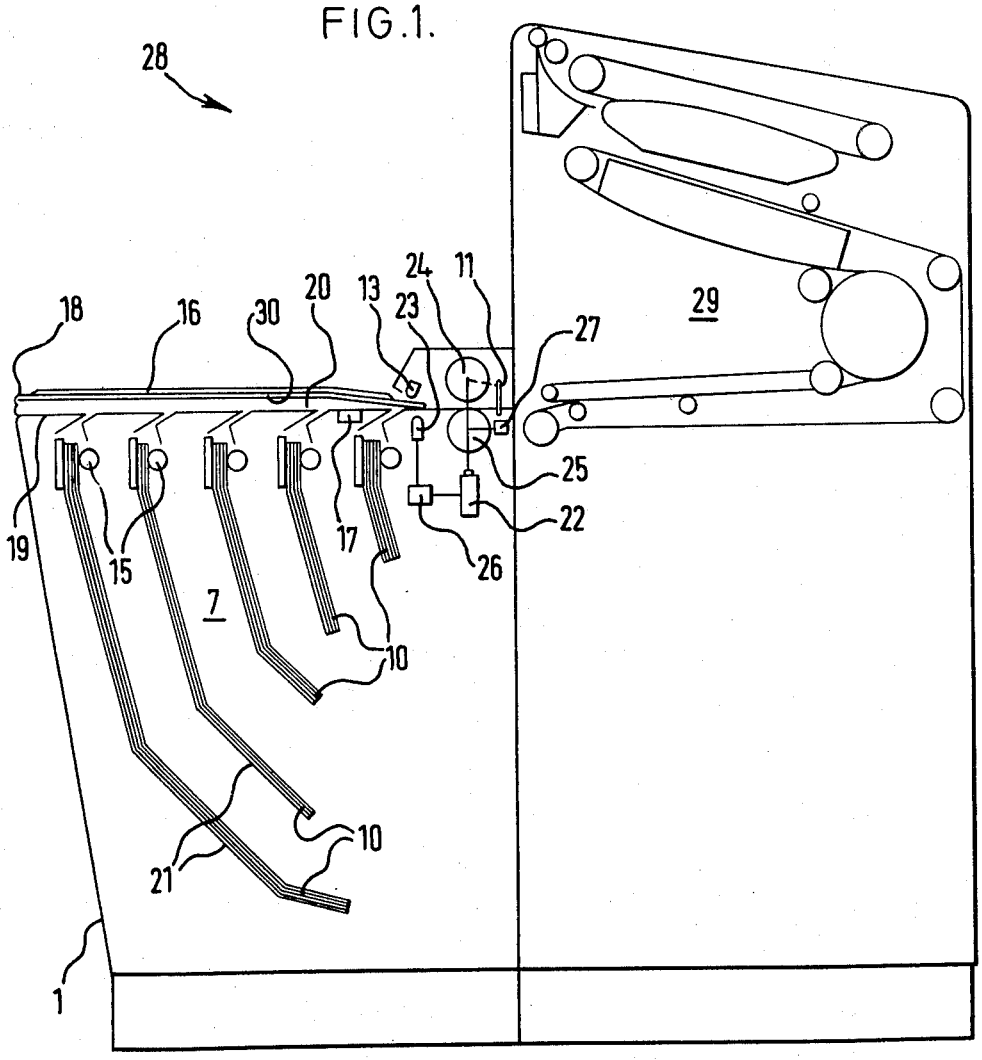
FIG. 1 is a schematic side view of a reprographic machine including an apparatus in accordance with a first embodiment of the present invention.
Figure 2:
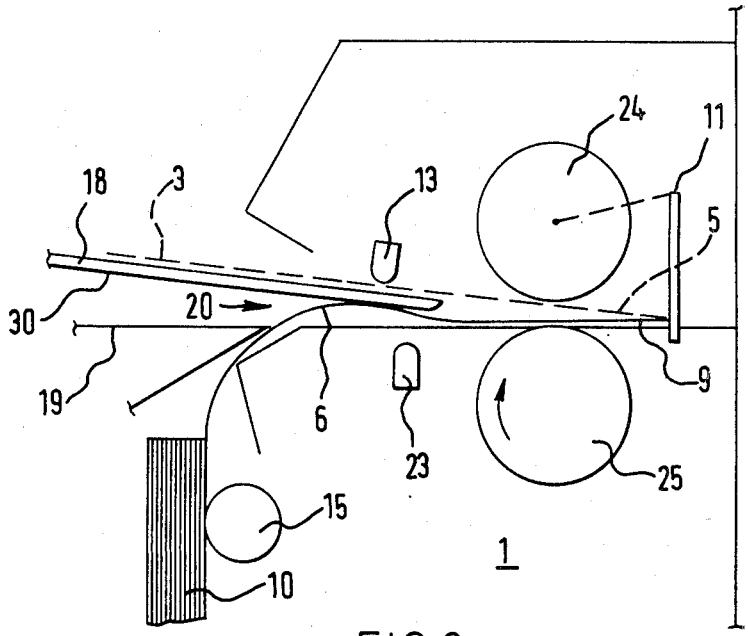
FIG. 2 is a view of a part of a machine similar to that of FIG. 1 drawn to a larger scale to show certain detail more clearly.
Figure 3:
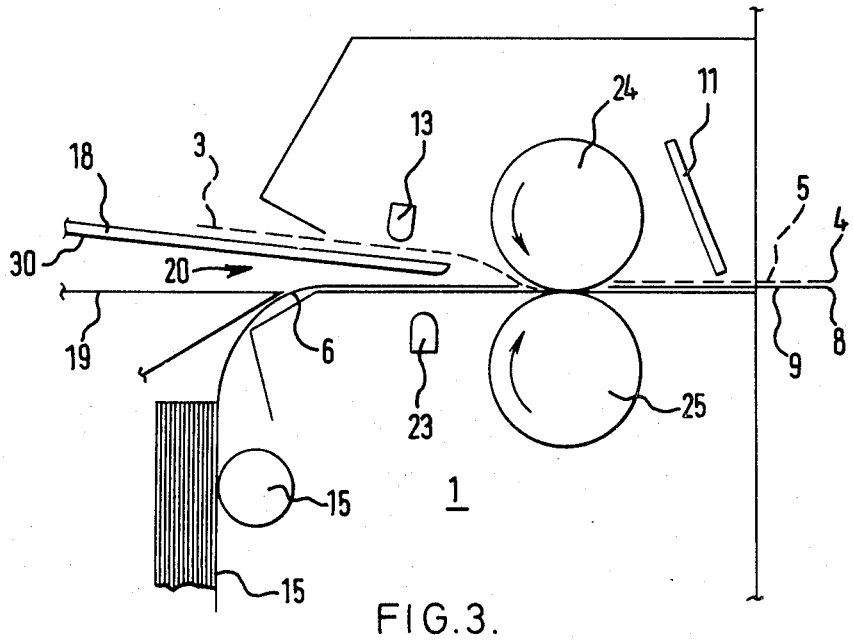
FIG. 3 is a view similar to FIG. 2, but showing the machine in another operative condition.

Referring to FIGS. 1, 2 and 3, a reprographic machine 28 includes an apparatus 1 according to the invention for automatically supplying to a copying station 29 of the machine a superimposed pair of sheets consisting of an upper, primary or original sheet 3 to be copied and a lower, secondary sheet 6 of copying paper.

The apparatus 1 comprises a store 7 for the secondary sheets 6 which are arranged in groups 10, each group corresponding to a different size of secondary sheet 6. The sheets 6 of each group 10 have different lengths, as is apparent from FIG. 1, but it is to be understood that the sheets 6 of each group 10 also have different widths as measured in planes perpendicular to the plane of the drawing. In the construction shown, the groups 10 comprise piles of sheets 6 positioned in trays 21 and a sheet 6 may be withdrawn upwardly out of a tray 21 by operation of a motor-driven roller 15. When a primary sheet 3 having a leading end portion 5 is fed over a first feed path, provided by the upper surfaces of upper and lower tables 18 and 19, to a movable fence 11 extending transversely across the upper surface of the lower table 19, the roller 15 of a group 10 is driven and a sheet 6 from that group 10 moves onto the upper surface of the lower table 19, which provides a second feed path for the secondary sheets 6 having a leading end portion 9, and the leading edge 8 of the sheet 6 arrives at the movable fence 11. The engagement of the sheet leading edge 8 with the fence 11 thus causes automatic alignment of the sheets 3 and 6. As hereinafter described, the motor-driven roller 15 is controlled so that the sheet 6 is moved further forward to assume a wave shape, as shown in FIG. 2, to better ensure alignment of the leading edge 8 of the sheet 6 with the fence 11. To ensure the alignment of the sheet 6, if free movement of the sheet 6 is restricted by contact with parts of the machine or other obstructions, the sheet 6 may also be subjected to the action of disturbing means 17, such as a vibrating plate or airjets.

The sheet 6 is also guided by the undersurface 30 of the upper guide table 18, the space 20 between the guide tables 18 and 19 allowing the sheet 6 to assume the wave shape. A guide surface 16 at the side of the upper table 18 ensures that the primary sheet 3 is correctly aligned with the fence 11. Thus, a pair of sheets 3 and 6 are correctly aligned square with each other and are suitably arranged together for the subsequent copying operation.

In accordance with the invention, a sheet 6 is automatically selected from the store 7 in dependence upon the size of the primary sheet 3. The size of the primary sheet 3 is measured by a row of first sensing means such as photocells 13 which sense the width of the leading edge 4 of the primary sheet 3 as it moves up to the fence 11. Clearly, some or all photocells 13 may be replaced by microswitches.

The number of first sensing means is one less than the number of trays 21. Thus, as shown, there are five trays 21 and four photocells 13. As the leading edge 8 of the sheet 6 is moved up to the fence 11, it passes under the row of photocells 13 and, depending on the width of the sheet 3, a corresponding number of photocells 13 are operated and a control signal is produced indicative of the primary sheet size. This control signal causes the operation of the motor-driven roller 15 of that store 7 having the correct sheet size to match the primary sheet 3. The roller 15, when activated, is caused to be driven by its motor so that it rotates through a predetermined angular extent and then stops, this angular extent being that required to advance the leading edge 8 of the secondary sheet 6 to abut the fence 11 and to produce a wave shape in the sheet 6, as hereinbefore described.

As schematically shown in FIGS. 1 to 3, the fence 11 is linked to a solenoid 22 and the fence 11 is movable out of the first and second paths of the sheets 3 and 6 to the position shown in FIG. 3 by the solenoid 22. The solenoid 22 is energised automatically by second sensing means 23, e.g. a photocell or microswitch, which senses a secondary sheet 6 when the leading edge 8 of the secondary sheet 6 has almost arrived at the fence 11. However, a time delay device 26 introduces a delay between the operation of the second sensing means 23 and the solenoid 22 to ensure that the sheet 6 is aligned with the fence 11 before the fence 11 is removed. Preferably, an interlock (not shown) is provided to prevent energisation of the solenoid 22 unless the primary sheet 3 is also aligned with the fence 11.

The apparatus 1 also includes an idler roller 24 and a driven roller 25, the idler roller 24 being movable relative to the driven roller 25 between the position shown in FIGS. 1 and 2 and the position shown in FIG. 3, by means of the solenoid 22. Thus, on removal of the fence 11, as shown in FIG. 3, the idler roller 24 simultaneously moves towards the driven roller 25 and the pair of aligned sheets 3 and 6 are fed forward to a copying station 29 in the reprographic machine 28, the rollers 24 and 25 stopping after a short time delay after the trailing edges of the sheets 3 and 6 have passed the second sensing means 23. Advantageously, the roller 25 is driven through a clutch 27 from a drive source within the copying station 29 so as to ensure that the aligned sheets 3 and 6 are fed forward at the correct speed.

Figure 4:
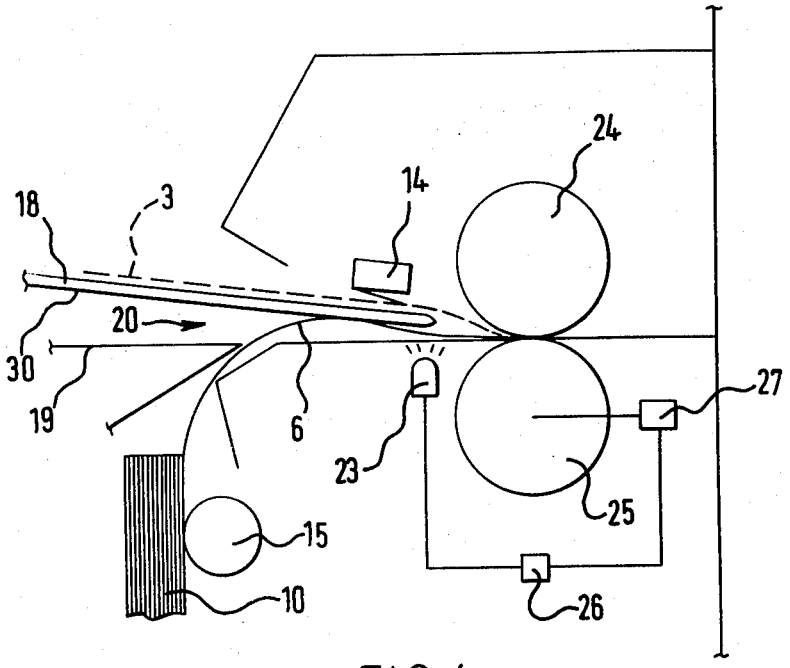
FIG. 4 is a view similar to FIG. 2, but relating to a reprographic machine including an apparatus in accordance with a second embodiment of the present invention.
Figure 5:
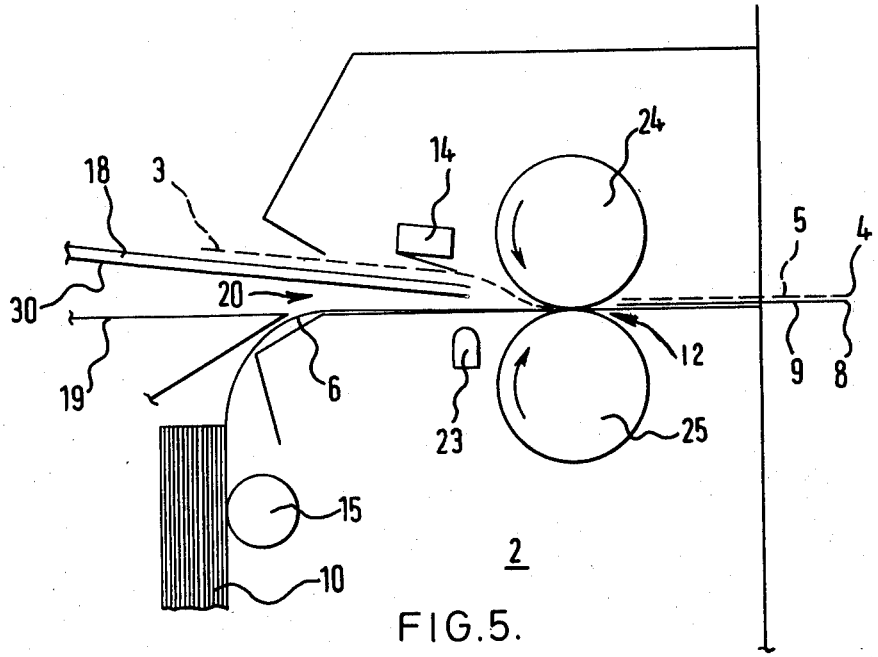
FIG. 5 is a view similar to FIG. 4, but showing the machine in another operative condition.

In a simplified embodiment of the invention provided by the apparatus 2 shown in FIGS. 4 and 5, the rollers 24 and 25 are pressed towards each other at all times and the fence 11 is omitted, its function being replaced by the nip 12 between the rollers 24 and 25. Second sensing means 23, in the form of a microswitch or a photocell, sense the presence of a secondary sheet 6 and, after a time delay sufficient for the leading edge 8 of the sheet 6 to be aligned with the nip 12, the clutch 27 of the lower, driven roller 25 is engaged and the two aligned sheets 3 and 6 are driven forward to the copying station 29 at the correct speed for copying. In other respects, this embodiment is similar to that of the embodiment illustrated in FIGS. 1, 2 and 3. However, in this second embodiment, the first sensing means are in the form of microswitches 14, but some or all of these may be replaced by photocells, as in the first embodiment illustrated in FIGS. 1, 2 and 3.

Although reference numerals have been used in the appended claims, it is expressly stated that these reference numerals should not be construed as limiting the claims to the constructions illustrated in the accompanying drawings.

I claim:

1. Apparatus for positioning a primary sheet having a leading edge and a leading end portion and for selecting a secondary sheet of a desired size in a store containing secondary sheets of different sizes which each having a leading edge and a leading end portion and are arranged in groups for dispensing the selected secondary sheet from the related group so that the secondary sheet is associated and aligned with the primary sheet, the secondary sheet being selected in accordance with the size of the primary sheet, characterised in that:

stop means are provided as an abutment for the leading edges of the primary and secondary sheets;

first sensing means are provided for sensing the size of the primary sheet and are adapted to operate so that as the primary sheet is fed into the apparatus, until its leading edge arrives at the stop means, the sensing means producing a control signal indicative of the size of the primary sheet; and dispensing means are provided for operation in response to the control signal for automatically selecting one of said groups and dispensing a secondary sheet therefrom so that the secondary sheet moves away from the group until after its leading edge arrives at the stop means, in which position the secondary sheet is associated and aligned with the primary sheet and the leading end portions of the primary and secondary sheets are in facing abutment with each other.

2. Apparatus according to claim 1, characterised in that:

the primary sheet and the secondary sheet are fed respectively along first and second feed paths;

the stop means extend transversely across the first and second feed paths;

the first feed path has a guide surface for ensuring that the primary sheet is square with the stop means; and the dispensing means operate such that when the secondary sheet engages the stop means, the secondary sheet is subjected to a compressive force and a wave shape is induced in the secondary sheet.

3. Apparatus, according to claim 2, characterised by disturbing means for subjecting the secondary sheet, when in its wave shape, to a mechanical vibratory force or to the action of jetted air, to facilitate alignment of the secondary sheet square with the stop means.

4. Apparatus, according to claim 2, characterised in that:

a first table and a second table situated below and spaced from the first table, said first table providing a first feed path for the primary sheet;

the second table providing a second feed path for the secondary sheet; and a space between said first and second tables allowing the secondary sheet to assume its wave shape.

5. Apparatus, according to claim 4, characterised in that:

trays are situated beneath said first and second tables;

the groups of the secondary sheets comprise piles of sheets arranged in said trays; and the dispensing means include motor-driven rollers for driving each secondary sheet out of a selected pile.

6. Apparatus, according to claim 1, characterised in that the first sensing means comprise at least one of photocells and microswitches.

7. Apparatus, according to claim 1, characterised in that:

the stop means comprise a movable fence;

a solenoid is provided for moving the fence;

second sensing means are arranged to be operated by a secondary sheet to actuate the solenoid prior to the arrival of the leading edge of the secondary sheet at the fence; and time delay means are provided to ensure that the solenoid removes the fence after a delay sufficient for the alignment of the leading edge of the secondary sheet with the fence.

8. Apparatus, according to claim 7, characterised in that:

two rollers are situated upstream of the fence on opposite sides of the first and second feed paths, one of said rollers being an idler roller and the other roller being a driven roller;

the idler roller is movable towards and away from the driven roller in conjunction with the movement of the fence the arrangement being such that when the fence is removed, the idler roller presses the sheets between itself and the driven roller so that the sheets are advanced together beyond the fence.

9. Apparatus, according to claim 2, characterised in that:

two rollers extend transversely across the first and second feed paths of the sheets to provide a nip;

the nip provides the stop means;

a clutch is provided for transmitting drive to one of the rollers; and second sensing means are situated adjacent and upstream the nip so as to be responsive to the presence of a secondary sheet at the nip and operate so that, after a time delay sufficient for the alignment of the secondary sheet at the nip, the clutch is engaged and the sheets are advanced together beyond the nip.

10. Apparatus, according to claim 1, characterised in that it is associated with or incorporated in a reprographic machine the primary sheet being an original to be copies and the secondary sheet being of copying paper.

* * * * *